US011234085B2

(12) United States Patent
Dominijanni et al.

(10) Patent No.: US 11,234,085 B2
(45) Date of Patent: Jan. 25, 2022

(54) EARPIECES AND RELATED ARTICLES AND DEVICES

(71) Applicant: Bose Corporation, Framingham, MA (US)

(72) Inventors: Andrew D Dominijanni, Waltham, MA (US); Lei Cheng, Wellesley, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/690,586

(22) Filed: Nov. 21, 2019

(65) Prior Publication Data

US 2021/0160627 A1 May 27, 2021

(51) Int. Cl.
*H04R 25/00* (2006.01)
*H04R 1/28* (2006.01)

(52) U.S. Cl.
CPC ..... *H04R 25/48* (2013.01); *H04R 1/288* (2013.01); *H04R 25/604* (2013.01); *H04R 25/652* (2013.01); *H04R 2225/021* (2013.01); *H04R 2225/025* (2013.01)

(58) Field of Classification Search
CPC ..... H04R 25/48; H04R 1/288; H04R 25/604; H04R 25/652; H04R 2225/021; H04R 2225/025; H04R 25/65; H04R 2225/77; H04R 2460/09; H04R 2460/11; H04R 2460/15; H04R 25/656
See application file for complete search history.

(56) References Cited

U.S. PATENT DOCUMENTS 7,079,662 B2 * 7/2006 Niederdr nk ..... H04R 25/652 381/322
10,425,714 B2 * 9/2019 Lawand ..... H04R 1/12
10,542,341 B2 * 1/2020 Higgins ..... H04R 25/60
2004/0218772 A1 * 11/2004 Ryan ..... H04R 25/456 381/328
2006/0137934 A1 * 6/2006 Kurth ..... A61F 11/08 181/135
2006/0269090 A1 * 11/2006 Sapiejewski ..... H04R 1/1083 381/371
2007/0201717 A1 * 8/2007 Dyer ..... H04R 1/1016 381/380
2008/0013767 A1 * 1/2008 Olsen ..... H04R 25/654 381/328
2009/0196444 A1 * 8/2009 Solum ..... H01Q 1/241 381/315
2011/0280425 A1 * 11/2011 Gibbons ..... H04R 1/1016 381/328
2012/0106774 A1 * 5/2012 Saiki ..... H04R 7/18 381/412
2013/0148830 A1 * 6/2013 Sakaguchi ..... H04R 1/2869 381/312
2015/0264467 A1 * 9/2015 Annunziata ..... H04R 1/1058 381/380
2018/0115839 A1 4/2018 Eichfeld et al.
2018/0359578 A1 * 12/2018 Boley ..... H04R 25/652
(Continued)

*Primary Examiner* — Mark Fischer
(74) *Attorney, Agent, or Firm* — Bose Corporation

(57) ABSTRACT

An earpiece includes an acoustic mass element, and an acoustic resistance element that is arranged acoustically in parallel with the acoustic mass element. The acoustic mass element and the acoustic resistance element are arranged to couple a user's ear canal to an external environment when worn.

16 Claims, 17 Drawing Sheets

(56) References Cited

U.S. PATENT DOCUMENTS

| | | | | |
|---|---|---|---|---|
| 2019/0356991 | A1* | 11/2019 | Farver | H04R 25/602 |
| 2020/0383613 | A1* | 12/2020 | Patnala | A61N 1/375 |
| 2021/0152924 | A1* | 5/2021 | Keady | H04R 1/1058 |

* cited by examiner

EARPIECES AND RELATED ARTICLES AND DEVICES

BACKGROUND

This disclosure relates to earpieces and related articles and devices, and, particularly, to earpieces and ear tips for hearing aids.

SUMMARY

All examples and features mentioned below can be combined in any technically possible way.

In one aspect, an earpiece includes an acoustic mass element, and an acoustic resistance element that is arranged acoustically in parallel with the acoustic mass element. The acoustic mass element and the acoustic resistance element are arranged to couple a user's ear canal to an external environment when worn.

Implementations may include one of the following features, or any combination thereof.

In some implementations, the acoustic mass element includes an acoustic port.

In certain implementations, the acoustic resistance element includes a resistive port.

In some cases, the restive port includes an acoustic port and an acoustically resistive material arranged to impede movement of acoustic energy through the acoustic port.

In certain cases, the acoustically resistive material includes a resistive screen.

In some examples, the resistive screen has an acoustic resistance of about 5 Rayl to about 500 Rayl.

In certain examples, the earpiece includes an earbud and an ear tip and at least one of the acoustic mass element and the acoustic resistance element are disposed on the tip.

In some implementations, both the acoustic mass element and the acoustic resistance element are disposed on the tip.

In certain implementations, the earpiece includes an earbud and an ear tip and at least one of the acoustic mass element and the acoustic resistance element are disposed on the earbud.

In some cases, both the acoustic mass element and the acoustic resistance element are disposed on the earbud.

In certain cases, the acoustic resistance element has an acoustic resistance of about 5 Rayl to about 500 Rayl In some examples, the earpiece includes an earbud and at least one of the acoustic mass element and the acoustic resistance element are disposed on the earbud.

In certain examples, both the acoustic mass element and the acoustic resistance element are disposed on the earbud.

In some implementations, the acoustic resistance element includes an acoustic damper.

In certain implementations, the acoustic damper includes a hollow tube and a resistive screen arranged to resist air flow through the hollow tube.

In another aspect, a hearing aid includes an earpiece that is configured to sit at least partially within the user's ear canal when worn. The earpiece includes an acoustic mass element, and an acoustic resistance element arranged acoustically in parallel with the acoustic mass element. The acoustic mass element and the acoustic resistance element are arranged to couple the user's ear canal to an external environment when worn.

Implementations may include one of the above and/or below features, or any combination thereof.

In certain examples, the hearing aid includes a casing that supports a processor and a microphone and is configured to sit behind a user's ear when worn. The earpiece is coupled to the casing.

In some implementations, the hearing aid includes an electro-acoustic transducer disposed within the casing. The earpiece is coupled to the casing via a tube for conducting acoustic energy from the electro-acoustic transducer to the earpiece.

In certain implementations, the hearing aid includes an electro-acoustic transducer disposed within the earpiece. The earpiece is coupled to the casing via wiring for electrically coupling the electro-acoustic transducer to the sound processor.

In some cases, the earpiece includes an earbud and an ear tip and at least one of the acoustic mass element and the acoustic resistance element are disposed on the tip.

In certain cases, the earpiece includes an earbud and an ear tip and at least one of the acoustic mass element and the acoustic resistance element are disposed on the earbud.

DETAILED DESCRIPTION

Figure 1:
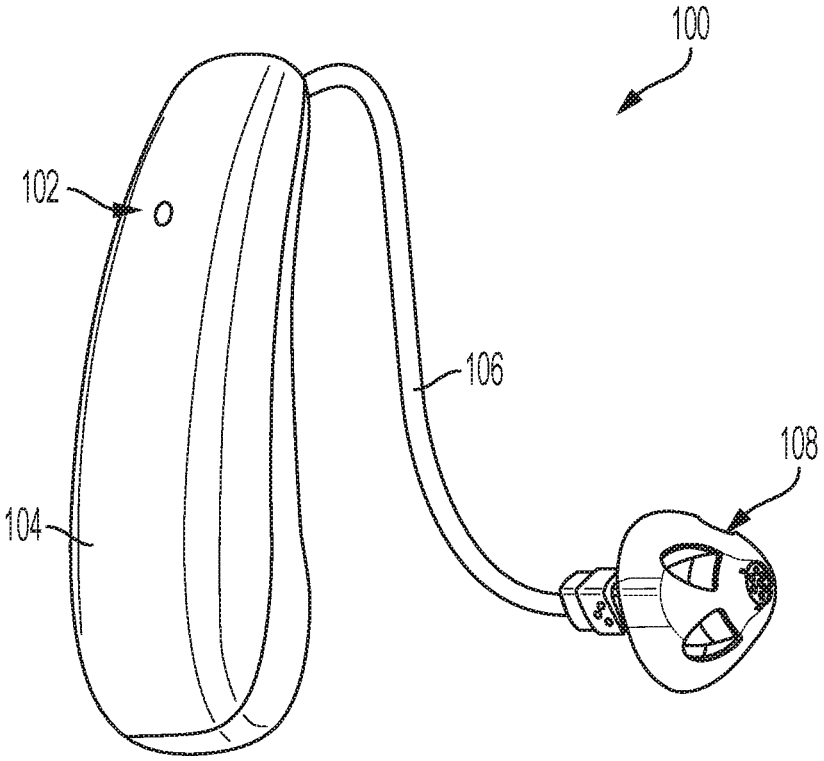
FIG. 1 is perspective view of a typical receiver-in-canal (RIC) hearing aid.

With reference to FIG. 1, a typical receiver-in-canal (RIC) hearing aid 100 includes a behind-the-ear portion 102 that includes a battery, a microphone, and a sound processor housed in a casing 104 designed to sit by a user's ear. This behind-the-ear portion 102 of the hearing aid 100 has a small wire 106 designed to run around the user's ear and into an ear piece 108 that is designed to sit in the user's ear canal. The earpiece 108 carries a speaker, also known as the "receiver" or "driver."

Behind-the-ear (BTE) hearing aids have a similar form factor, with a case that sits behind a user's ear, and attached ear piece that directs sound to the user's ear canal. While both RIC and BTE hearing aids are technically behind-the-ear, the BTE has more components behind the ear. In that regard, the BTE hearing aids have the microphone, receiver (speaker), battery, and sound processor all behind the ear, with just a tube running around the ear and into the ear piece for conducting acoustic energy from the speaker to the user's ear canal.

Figure 2A:
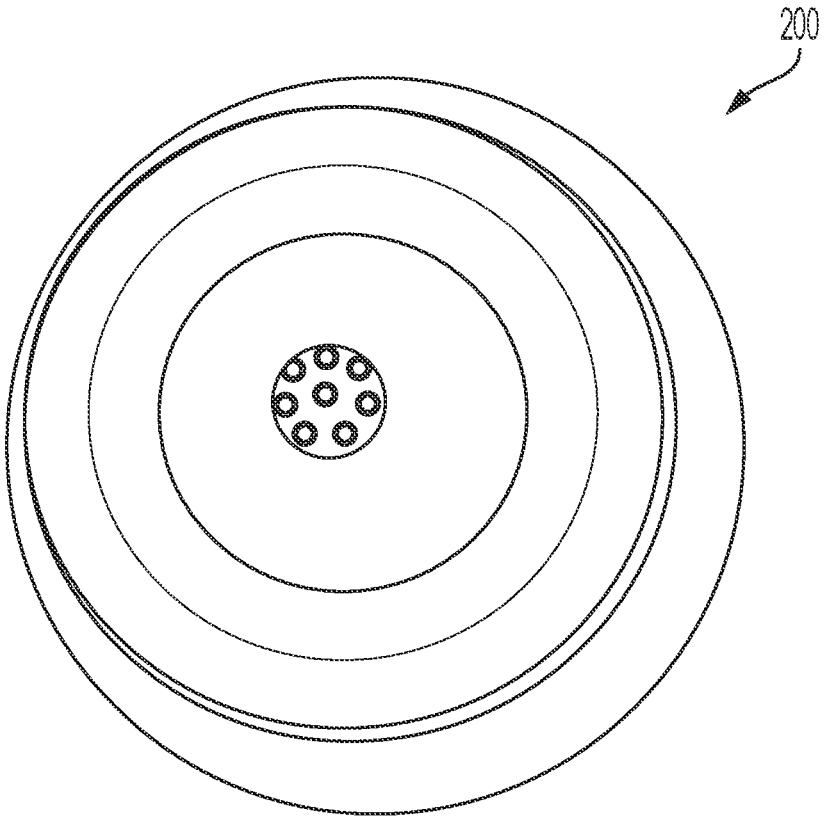
FIG. 2A is a front view of a closed dome ear tip for a hearing aid.
Figure 2B:
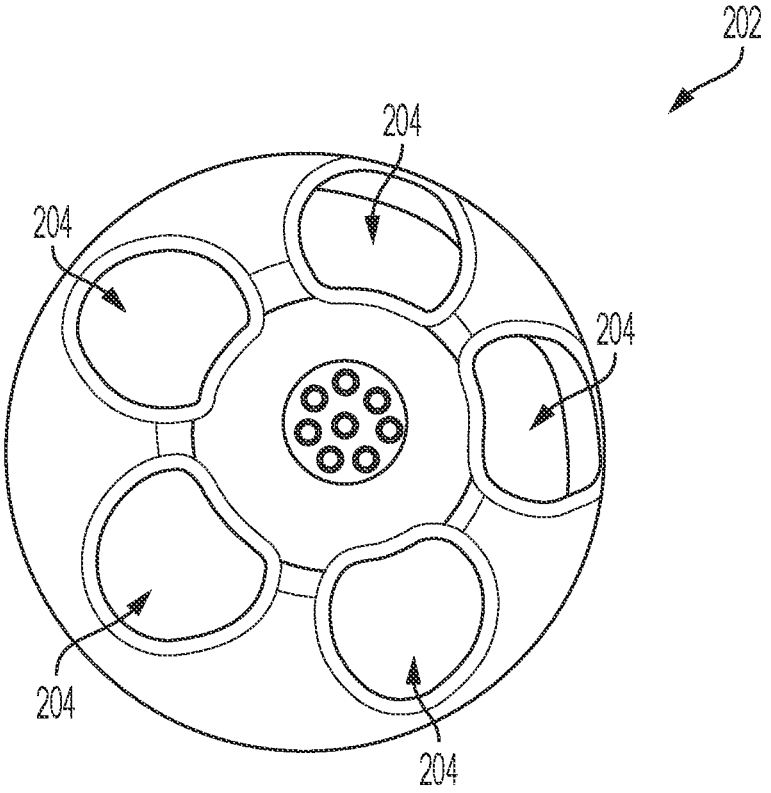
FIG. 2B is a front view of an open dome ear tip for a hearing aid.

Conventional RIC and BTE style hearing aids often include a compliant tip on the ear piece for engaging the user's ear canal, which help to keep the ear piece in place within the user's ear canal. These ear tips, or "domes," are typically either i) closed—forming a tight acoustic seal with the user's ear canal (see "closed dome 200" of FIG. 2A); or ii) open—having a number of large apertures 204 that allow acoustic energy to move into and out of the user's ear canal with little resistance (see "open dome 202" of FIG. 2B).

The closed dome configuration suffers from what is known as the occlusion effect. The occlusion effect amplifies lower-frequency components of the user's own voice due to the acoustic blockage of the ear canal. Pressure due to the user's voice radiates through the head and into the ear canal. When the ear is not occluded, the pressure escapes out of the ear; when the ear is occluded, and the pressure cannot escape, low-frequency components are grossly amplified inside the user's ear. Occluding the ear causes an additional problem—blocking of the ear canal prevents higher frequency components of the user's voice from traveling around the head and back in the ear. These two issues result in undesirable own-voice quality, typically perceived as the user's voice being "boomy" or "muffled." By "own-voice," we refer to the user's perception of their own voice while speaking.

The open dome configuration relieves this occlusion effect, but it introduces other problems. First, the open dome creates an acoustic feedback path between the speaker output and the microphone on the outside of the device, which is meant to detect sound surrounding the user for amplification. The increase in acoustic coupling between the speaker output and microphone input makes the system more susceptible to acoustic oscillation, i.e., audible feedback or squealing. Oscillation is prevented by several measures, but most effectively by reducing the maximum amount of gain the device can apply, so that it doesn't reach the point where oscillation occurs. This prevents instability but compromises the ability of an amplified product to provide its intended function. We refer to the maximum gain that can be applied without causing oscillation, at any frequency, as maximum stable gain.

Second, the open dome configuration reduces the efficiency and bandwidth of the speaker in delivering sound to the ear. The acoustic impact of the open dome configuration is such that the speaker must drive a larger effective acoustic volume. This significantly lowers the acoustic system efficiency, especially at lower frequencies. This in turn can result in poor bandwidth, for example, the low-frequency cut-off of the system may be insufficient for reproducing the lowest frequencies of speech, let alone music.

Third, the open dome configuration allows more sound from the environment to pass through the device and enter the ear than if there were no apertures in the dome. This "passive path" through the device is combined inside the ear with the "aided path," which is the output of hearing-related signal processing through the loudspeaker, e.g., an amplified representation of the outside sound. We refer to the reduction of sound reaching the ear through the passive path, due to the presence of the earphone, as passive insertion loss. The apertures in the open dome configuration makes the passive insertion loss lower, which increases the magnitude of the passive path contribution to the combined (active plus passive) signal. Several problems result from the increased passive path contribution.

When the acoustic signals from the passive and aided paths are similar in magnitude and close but not identical in arrival time at the ear drum, spectral combing occurs. This is because the aided path is correlated with the passive path but contains greater latency (later arrival time) due to the signal processing. In some examples, the amount of latency is as high as 5 ms; even latency of 1 ms may be distracting. This interaction can result in the perceived spectrum of environmental sounds being "tinny," "comby," "tube-like," or otherwise undesirable and of poor fidelity. The perceptibility of this effect can be reduced by adding substantial gain to the aided path. Up to 20 dB of gain may be required on the aided path to significantly suppress the combing effect, i.e., by vastly exceeding the contribution of the passive path, but this amount of gain may exceed the maximum stable gain of the device. That much gain may also be uncomfortably loud for the user when the environmental sound level is already high and audible through the passive path, or if the user has only a mild impairment.

This disclosure is based on the realization that a better balance may be struck between acoustic impedance and low frequency output if the acoustic impedance can be increased to a point at which occlusion is just noticeable.

Figure 3:
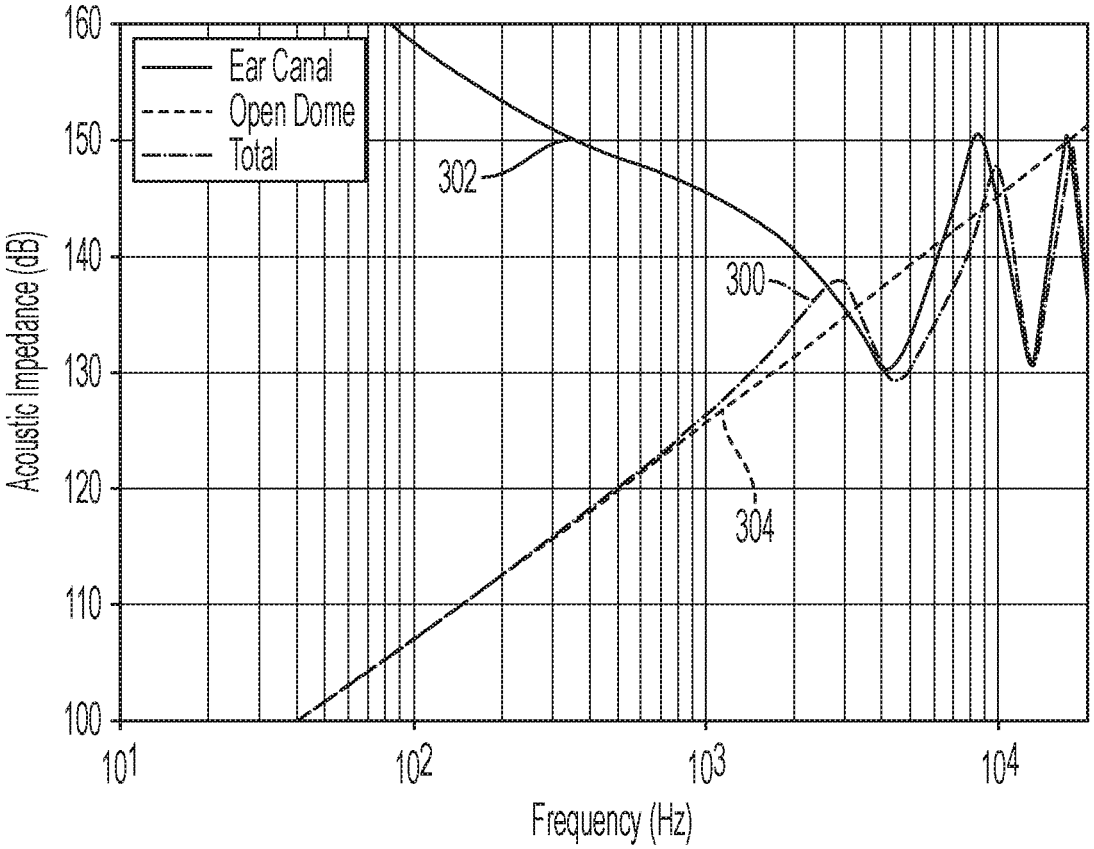
FIG. 3 is a plot of example impedances looking into an ear canal and dome.

FIG. 3 shows example impedances in an ear canal with and without an open dome. As shown in the figure, the impedances of the ear canal and dome in parallel determine how much acoustic pressure results in the ear for a given ear canal wall volume velocity. To first order, this impedance is the same as that seen by a speaker in a person's ear canal, so the same simple model can be used to estimate how much pressure is created by motion of the speaker's diaphragm. FIG. 3 illustrates that the pressure that occurs at the ear (curve 300) is the combination of the ear canal impedance (curve 302) and the dome impedance (curve 304). As can be seen in the graph, when the dome impedance is much lower, it controls the pressure; and when the ear canal impedance is much lower, it controls the pressure.

Figure 4:
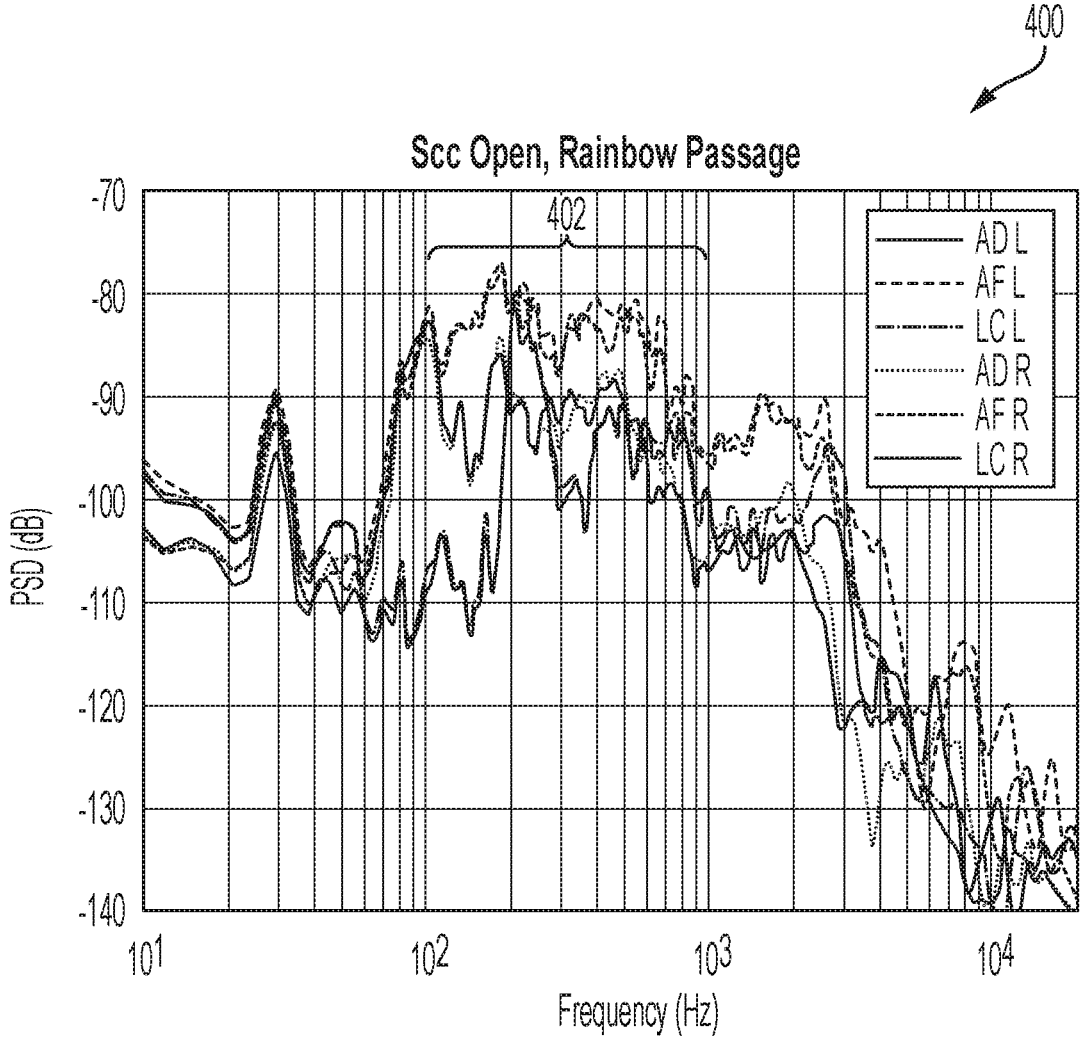
FIG. 4 is a measurement of power spectral density for a microphone in an open ear canal with wearer (or "subject") speaking as measured at left and right ear canals for each of three subjects.

Referring now to FIG. 4, which is a plot 400 of the power spectral density for a microphone in an open ear canal with a subject speaking, as measured at both left (L) and right (R) ear canals for three (3) subjects (identified here as AD, AF, and LC). As evidenced by way of comparison of FIGS. 3 and 4, the pressure created by the motion of the ear canal wall is almost totally controlled by the impedance of the dome (FIG. 3) in the frequency range with the most speech energy (FIG. 4), e.g., below about 1000 Hz. The fact that the open dome has low occlusion indicates that the impedance of the dome could possibly be increased without disturbing the user. This led to the hypothesis that there is a dome impedance curve that would increase the acoustic pressure in the ear to just the point of being noticeable by the user, hereinafter "Just Noticeable Occlusion" (JNO). This could then allow the most possible output from the speaker while maintaining the desirable low-occlusion experience.

Figure 5:
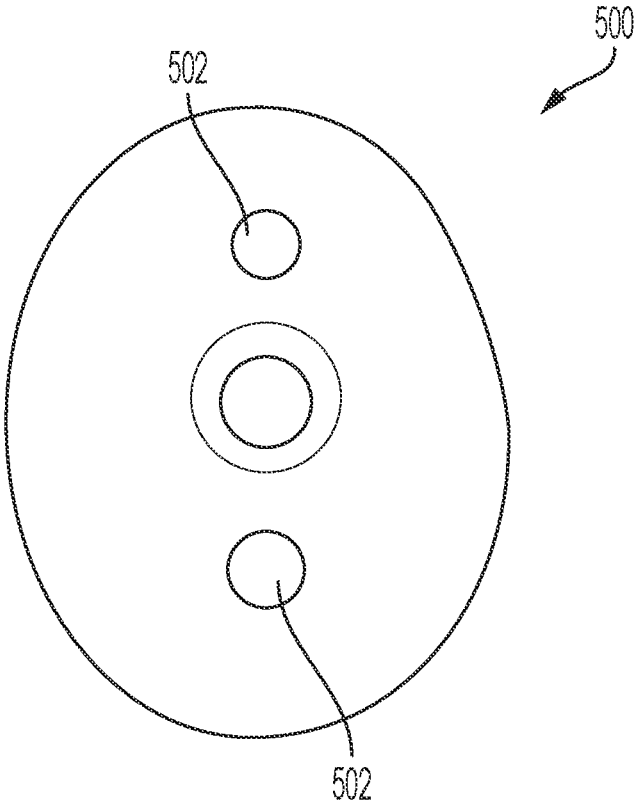
FIG. 5 is photograph of a protype dome-style ear tip with two acoustically parallel open holes ("ports").

FIG. 5 shows a first prototype that attempts to balance acoustic impedance and low frequency output by incorporating a number of smaller holes. In the exemplary prototype, the dome 500 includes two holes 502 that are each 1.5 mm in diameter. The dome 500 having a thickness of approximately 1 mm.

Figure 6A:
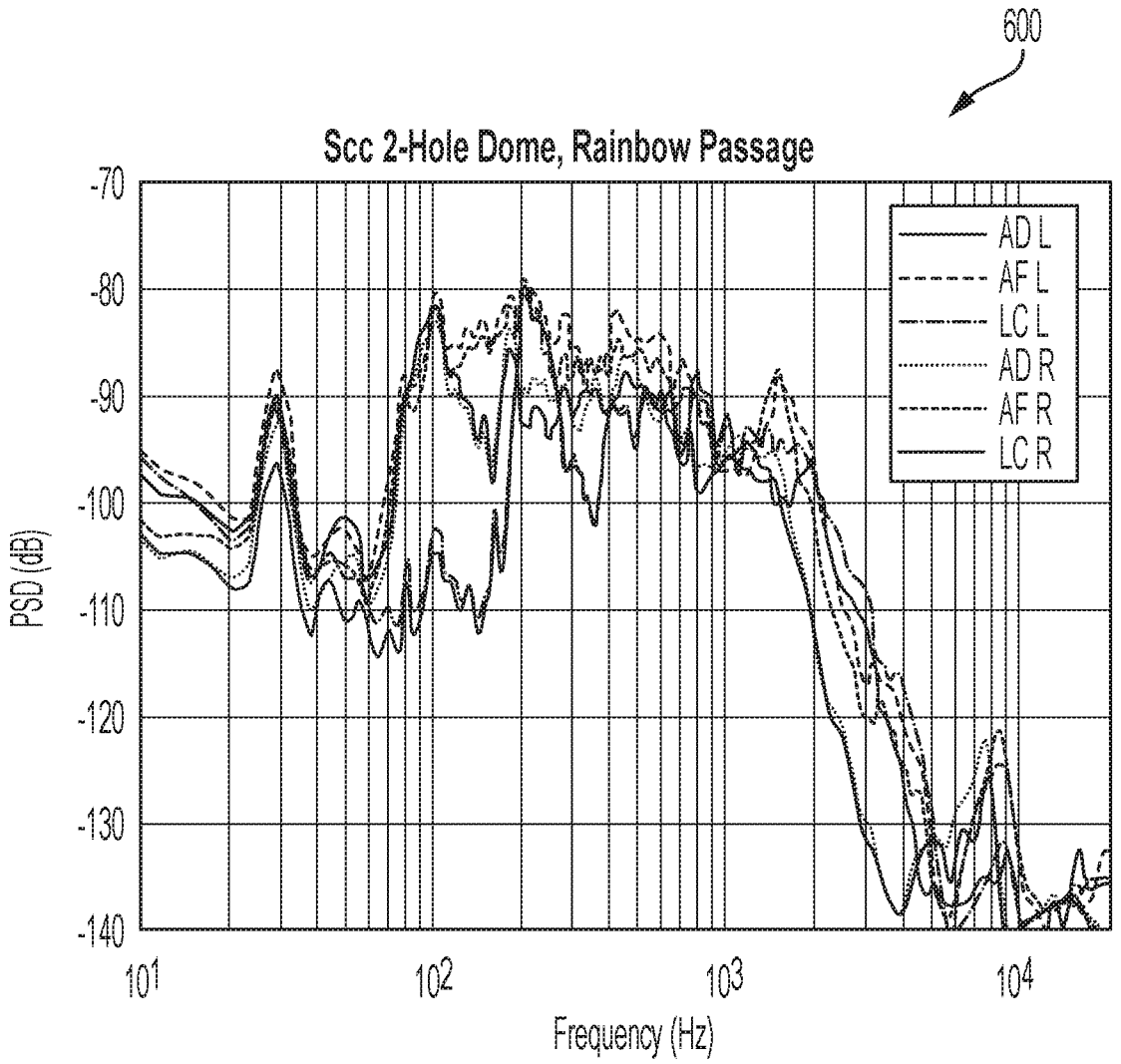
FIG. 6A is a plot of a measured power spectral density for the two-hole dome of FIG. 5 measured at left and right ear canals for the same three (3) subjects that were measured to produce FIG. 4.
Figure 6B:
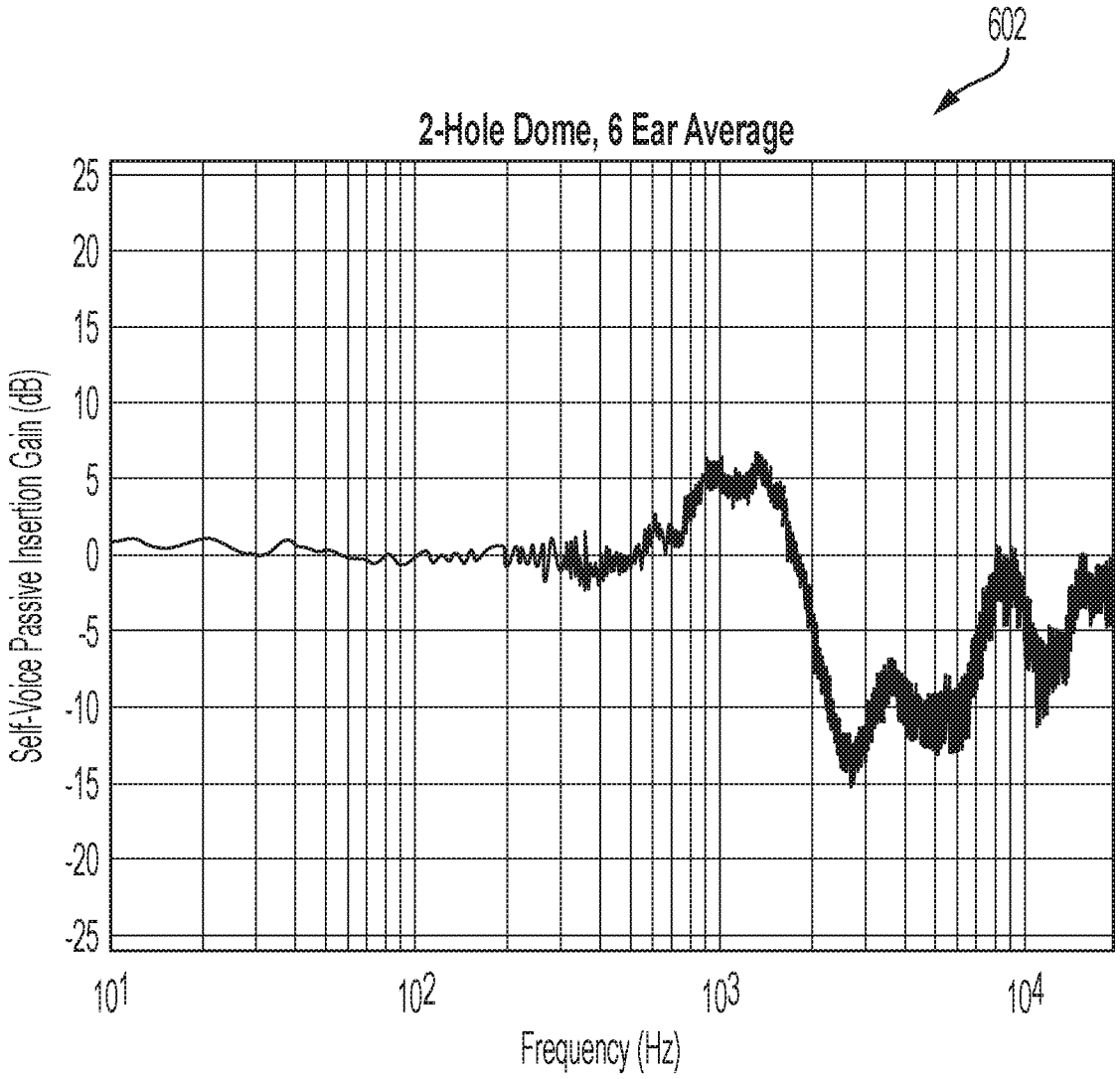
FIG. 6B shows a plot of an occlusion ratio, which is the ratio of the occluded power spectrum of FIG. 6A to the open power spectrum of FIG. 4.

FIG. 6A shows a plot 600 of the measured power spectral density for the two-hole dome of FIG. 5 measured at left and right ear canals for the same three (3) subjects (AD, AF, and LC) that were measured to produce FIG. 4, and FIG. 6B shows a plot 602 of the occlusion ratio, which is the ratio of the occluded power spectrum to the open power spectrum averaged across ears/heads. The subjects noted that occlusion was just noticeable and not objectionable. This measurement suggests that there is some residual occlusion around 1 kHz, but none below that. By way of comparison to FIG. 3, this suggests that the impedance of the dome at 1 kHz is about at the upper limit desired for JNO, but that it is likely still lower than necessary from ca. 100 Hz to 500 Hz. From this, it was hypothesized that the ideal impedance might look more like that shown in FIG. 7.

Figure 7:
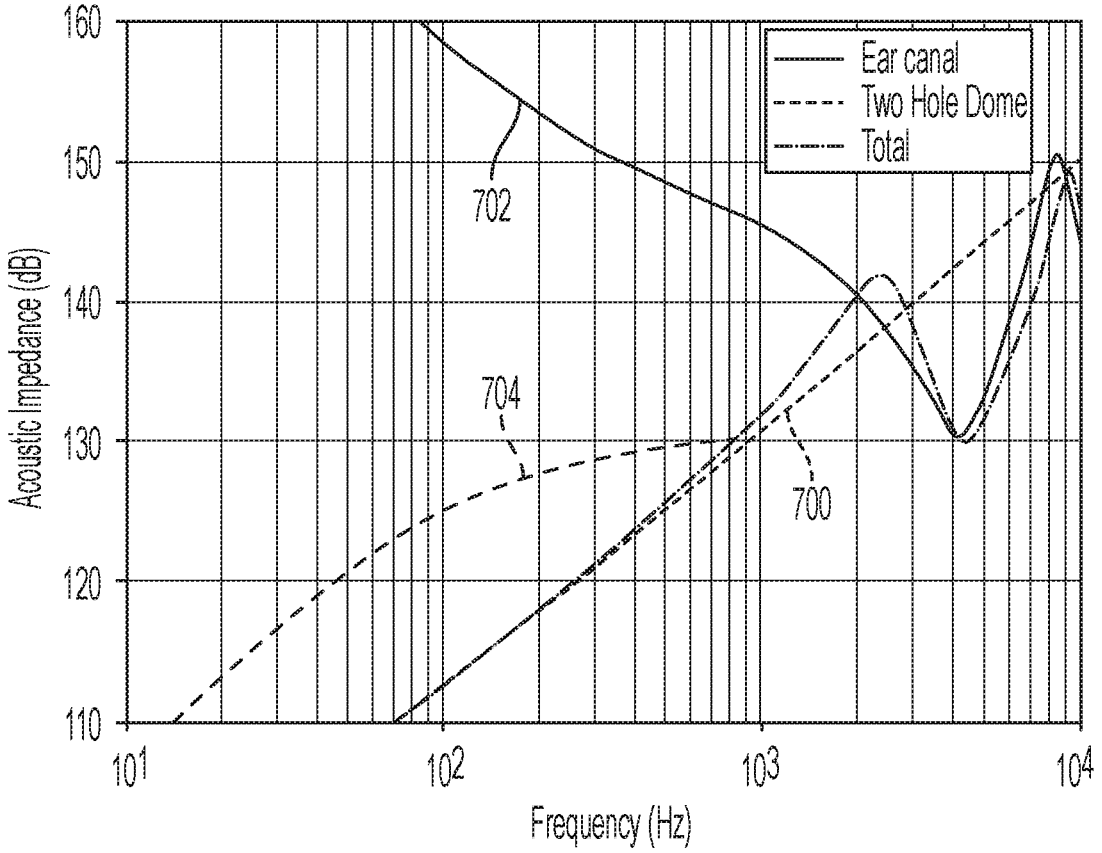
FIG. 7 is a plot of impedance for the two-hole dome with a hypothetical target.

FIG. 7 shows the impedance for the two-hole dome (curve 700) along with the ear canal impedance (curve 702) and a hypothetical target (curve 704) for JNO. To achieve this, parallel acoustic mass (open holes) and acoustic resistance (holes covered with resistive mesh screens) elements were experimented with. The combination of an open hole acoustically in parallel with a resistive screen-covered hole has the effect of increasing the impedance at lower frequencies, while maintaining the high frequency impedance, moving closer to the hypothetical JNO target impedance shape.

Figure 8:
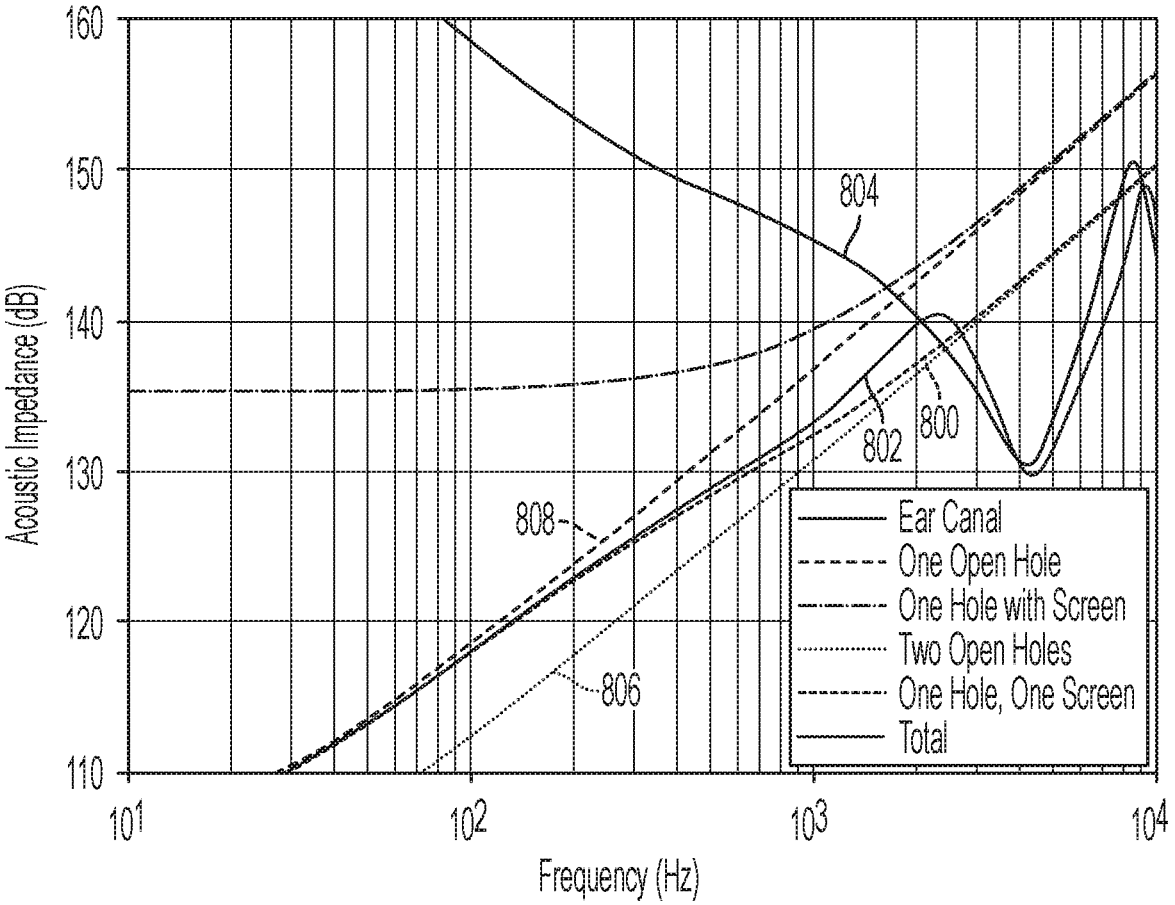
FIG. 8 is a plot of impedance shaped by dome with an acoustic mass element and an acoustic resistance element arranged acoustically in parallel.

A model for this type of impedance is illustrated by curve 800 in FIG. 8. This was achieved by adhering a screen, an "acoustic resistance," to one of the existing open holes in the two-hole dome 500 (FIG. 5). FIG. 8 again illustrates that the pressure that occurs at the ear (curve 802) is the combination of the ear canal impedance (curve 804) and the dome impedance (curve 800). However, as shown in FIG. 8, the combination of a screen-covered hole in parallel with an open hole (curve 800) enables an increase to the impedance at low frequencies, while maintaining the impedance at high frequencies as compared to the two-hole dome (curve 806). As evidenced in FIG. 8, at low frequencies, e.g., below about 70 Hz, the dome with one open hole acoustically in parallel with a screen-covered hole behaves like a dome with only a single open hole (curve 808). Then, at higher frequencies, the screen-covered hole starts to act like a second open hole and the curve 800 begins to match the curve 806 for the two-hole dome.

Thus, at high frequencies, the dome with one open hole and one screen covered hole in parallel looks like it has just two open holes in parallel, so the impedance drops because, in effect, a second hole is added. And, at the lowest frequencies, the energy chooses the path of least resistance, which is the open hole, but now it looks like the dome has just one hole instead of two holes, because the screen is blocking the other hole, since the impedance of the screen-covered hole at lower frequencies is so much higher. As a result, the high frequency impedance is maintained at just noticeable levels, while impedance is increased at the lower frequencies closer to just noticeable levels.

Figure 9:
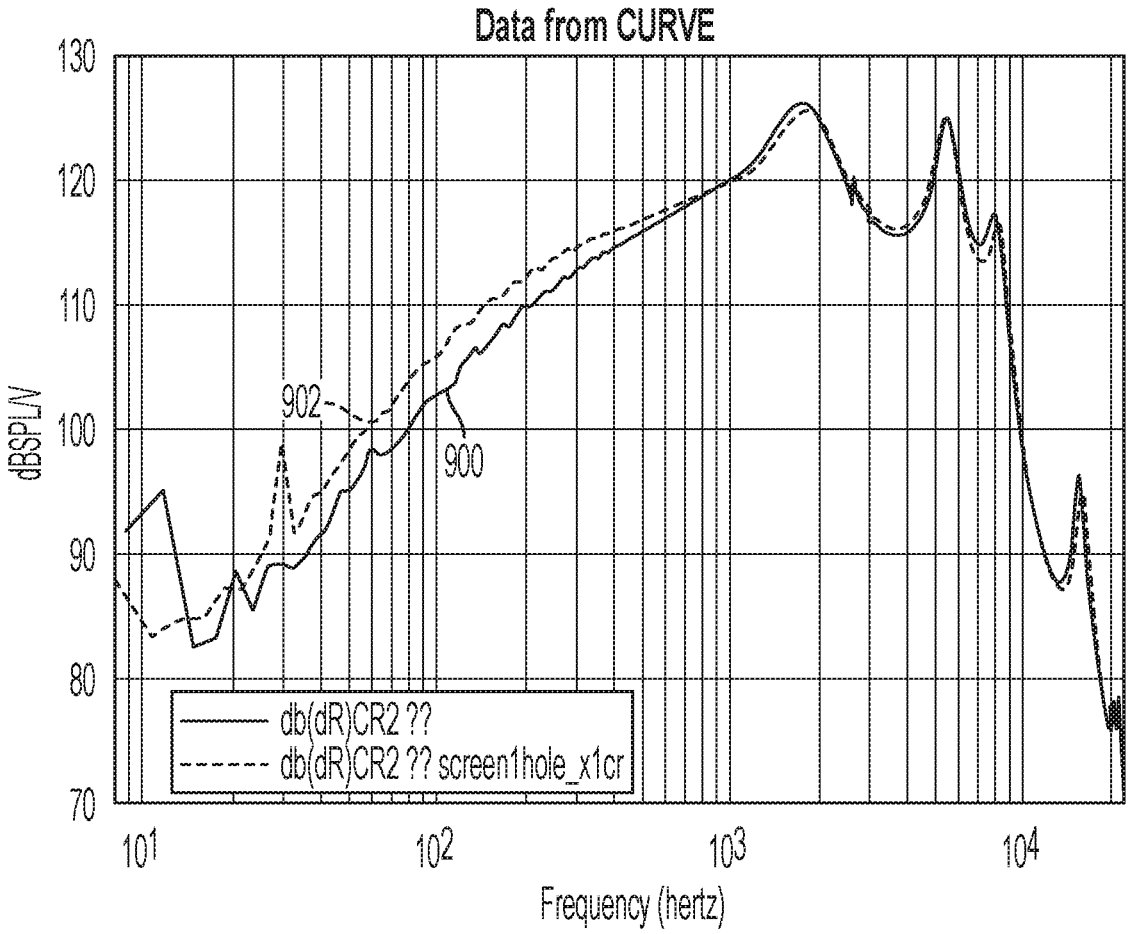
FIG. 9 is a speaker frequency response for a two-hole dome and a dome with one acoustic mass element and one acoustic resistance element.

FIG. 9 shows a speaker frequency response for the two-hole dome (curve 900) and the one open hole, one screen-covered hole dome (curve 902). FIG. 9 illustrates the extra acoustic output from a speaker that is achieved at the ear drum with the combination of an open hole and a screen-covered hole. As evidenced in FIG. 9, the configuration with one open hole in parallel with one screen-covered hole is 3-4 dB higher than the two-hole dome at low frequencies.

A secondary benefit of increasing the dome impedance is that increased insertion gain (rejection of outside sound) at high frequencies, above 2 kHz, can help reduce combing when the time-delayed aided path is played into the ear and sums with the direct passive sound from the environment.

Figure 10A:
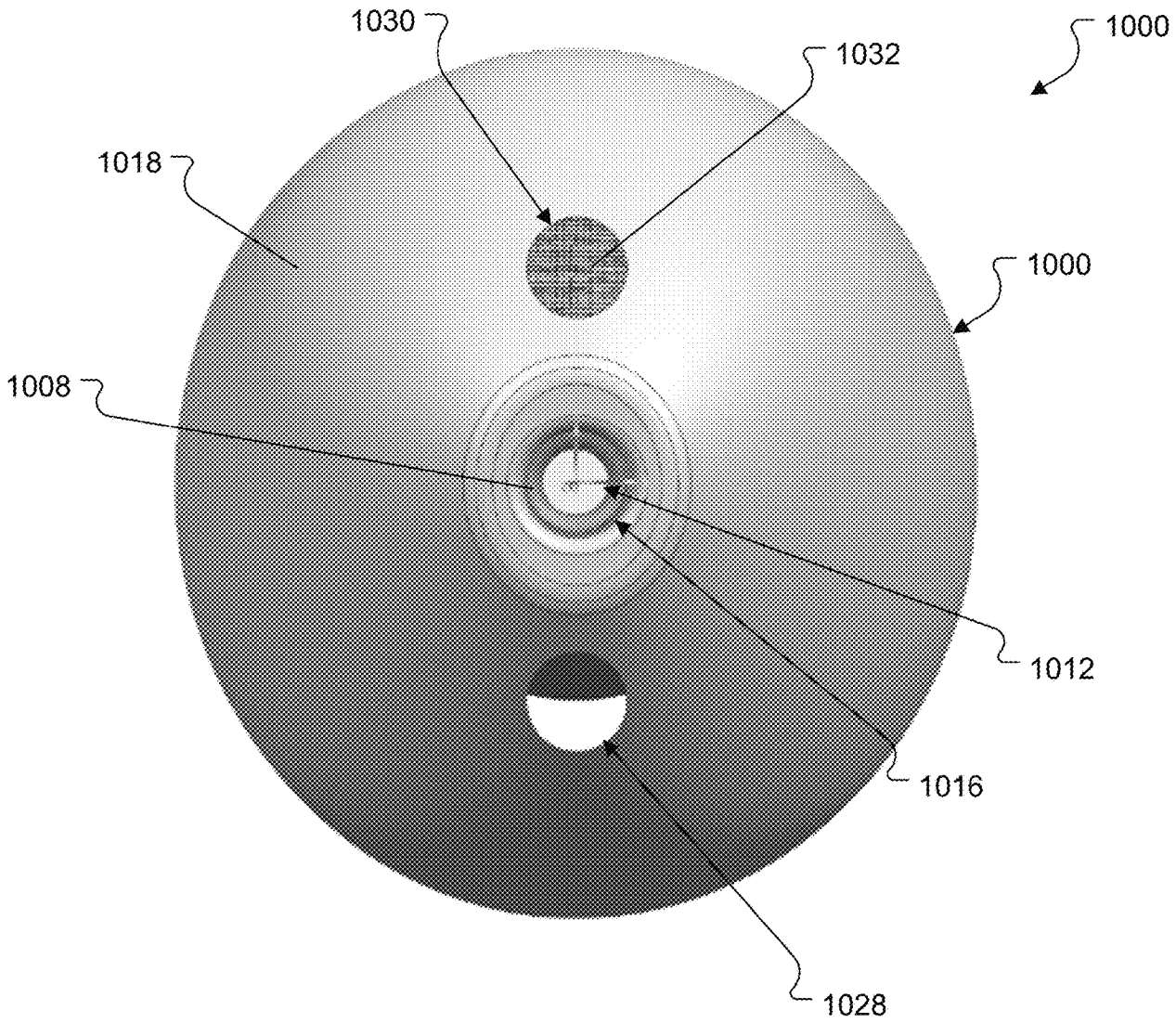
FIGS. 10A and 10B are front and cross-sectional side views, respectively, of an earpiece that includes an acoustic mass element and an acoustic resistance element arranged acoustically in parallel in an ear tip.
Figure 10B:
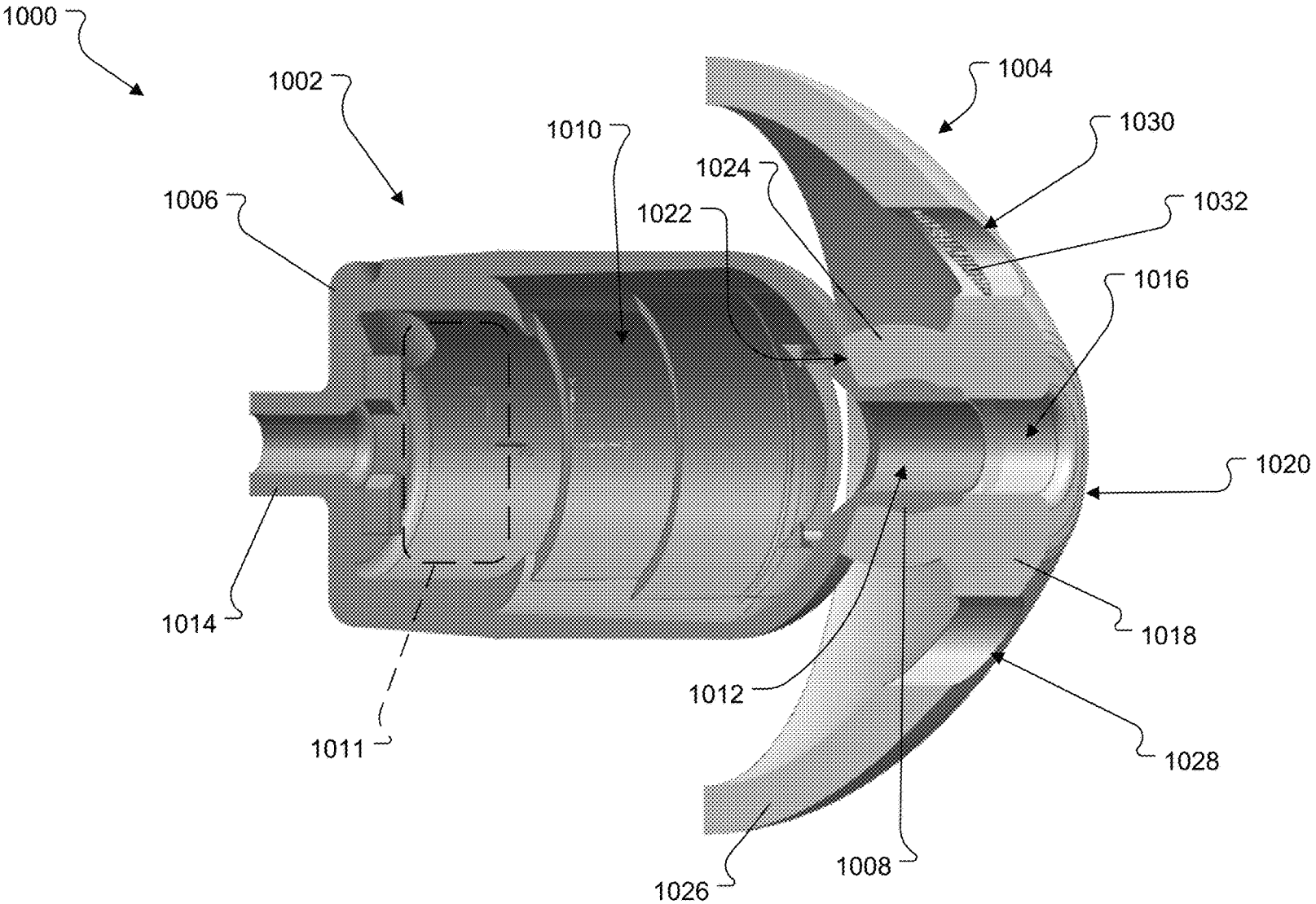

FIGS. 10A & 10B show an exemplary earpiece 1000 constructed in accordance with this disclosure. The earpiece 1000 includes an earbud 1002 (FIG. 2B) and an ear tip 1004. The earbud 1002 includes a housing 1006 that defines a nozzle 1008 that is configured to be coupled to the ear tip 1004. The housing 1006 may be formed of, e.g., molded form, a hard plastic such as Acrylonitrile Butadiene Styrene (ABS), Polycarbonate/Acrylonitrile Butadiene Styrene (PCB/ABS), polyetherimide (PEI), or stereolithography (SLA) resin). The housing 1006 defines a cavity 1010 (FIG. 10B) within which an electro-acoustic transducer 1011 (FIG. 10B) (a/k/a "speaker," or "receiver," or "driver") may be disposed, e.g., for a RIC style hearing aid. The cavity 1010 is acoustically coupled to an acoustic passage 1012 in the nozzle 1008, e.g., such that the electro-acoustic transducer 1011 can be acoustically coupled to a user's ear when the earpiece is worn. The housing 1006 also defines a receptacle 1014 (FIG. 10B) for receiving wiring for powering the electro-acoustic transducer 1011. Alternatively, the receptacle 1014 may receive a tube for conducting acoustic energy from an externally arranged electro-acoustic transducer to the cavity 1010, e.g., for a BTE style hearing aid. In that configuration, the cavity 1010 acoustically couples the tube to the acoustic passage 1012 in the nozzle 1008.

The ear tip 1004 is in the shape of a hollow cylinder with a hollow passage 1016 that is configured to receive the nozzle 1008 of the earbud 1002. The ear tip 1004 is configured to fit at least partially within a person's ear canal. The ear tip 1004 includes a body 1018 that is configured to received and/or be mounted onto the earbud 1002. The body 1018 includes a first end 1020 and a second end 1022 opposite the first end 1020. The body 1018 further includes inner wall 1024 extending between the first end 1020 the second end 1022. The inner wall 1024 defines and surrounds the hollow passage 1016 which can be configured to conduct sound waves. The body 1018 also includes an outer wall 1026 connected to the inner wall 1024 at the first end 1020. The outer wall 1026 extends away from the inner wall 1024 toward the second end 1022. In the illustrated example, the outer wall 1026 is dome-like in shape; however other shapes, such as frustoconical, are contemplated. As shown in FIG. 10B, the outer wall 1026 extends beyond the second end 1022. In alternative implementations, the outer wall 1026 may extend toward, but not necessarily reach the second end 1022.

The body 1018 can be made of any suitable soft, flexible materials, including, for example, silicone, polyurethane, polynorbornene (e.g., Norsorex® material available from D-NOV GmbH of Vienna, Austria), thermoplastic elastomer (TPE), and/or fluoroelastomer. In some implementations, the inner wall 1024 and the outer wall 1026 can be formed of different materials, e.g., in an additive manufacturing or two-shot molding process. In some cases, the inner wall 1024 may be formed of a higher durometer material, e.g., to ensure good coupling to the nozzle 1008, and the outer wall 1026 may be formed of a lower durometer material, e.g., for compliance (to ensure a good acoustic seal) and comfort.

The outer wall 1026 is configured to engage a user's ear canal when worn and to form an acoustic seal therebetween. Notably, the ear tip 1004 is provided with an acoustic mass element, in the form of a first, open (unobstructed) hole 1028 or "port" (a/k/a "acoustic port"), and an acoustic resistance element, in the form of a second hole 1030 with an acoustically resistive material, e.g., a resistive screen 1032, disposed therein to provide a resistive port. The acoustic mass and acoustic resistance elements are acoustically in parallel and are arranged to acoustically couple a user's ear canal to the external environment when the earpiece 1000 is worn so as to provide a one open hole and one screen-covered hole configuration, such as described above, for just noticeable occlusion.

The first, open hole 1028 is about 1 mm to about 3 mm in diameter, e.g., 1.5 mm in diameter. The second hole 1030 is also about 1 mm to about 3 mm in diameter, e.g., 1.5 mm to 2 mm in diameter. Both the first and second holes 1028, 1030 extend through the outer wall 1026 which has a thickness of about 1 mm in the region of the first and second holes 1028, 1030. The acoustically resistive material may have an acoustic resistance of about 5 Rayl to about 500 Rayl, e.g., about 5 Rayl to about 100 Rayl. Suitable resistive screens in the form of woven polyester are available from Sefar Inc., Buffalo, N.Y. The resistive screen 1032 may be secured over one open end of the second hole 1030, e.g., using a room temperature vulcanizing (RTV) silicone. Alternatively, the screen 1032 may be insert molded with the body 1018. Alternatively, a separate resistive element in the form of a small cylindrical housing carrying an acoustically resistive material (e.g., a screen) may be inserted into the second hole 1030 and/or insert molded with the body 1018. Suitable resistive elements of this type include acoustic dampers commercially available from Knowles Electronics, LLC., Itasca, Ill.

Figure 11:
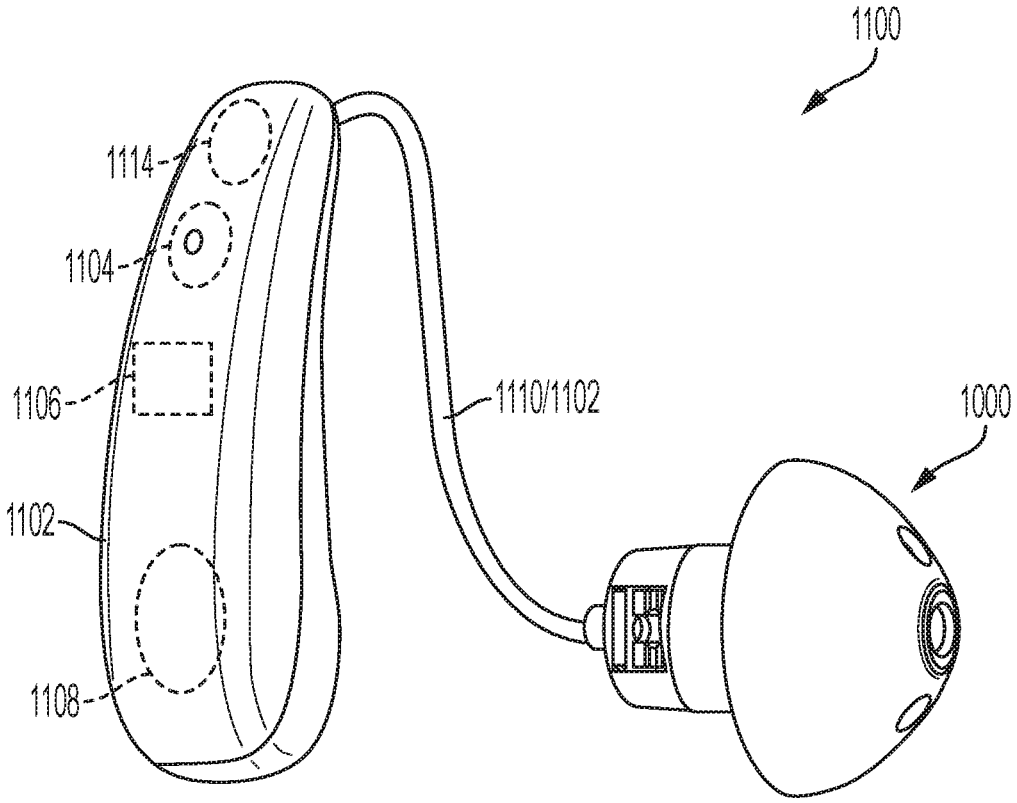
FIG. 11 is a perspective view of a hearing aid with the earpiece of FIG. 10A.

As shown in FIG. 11, the earpiece 1000 may be incorporated into a hearing aid 1100. The hearing aid 1100 includes the earpiece 1000 and a casing 1102, which houses a microphone 1104, sound processor 1106, and battery 1108 for powering the microphone 1104 and processor 1106. In the case of a RIC style hearing aid, the earpiece 1000 is coupled to the casing 1102 via wiring 1110 which electrically couples the sound processor 1106 to the electro-acoustic transducer in the earpiece 1000.

In the case of a BTE style hearing aid, the earpiece is coupled to the casing via tubing 1112 for conducting acoustic energy from an electro-acoustic transducer 1114 supported in the casing 1102 to the earpiece 1000.

Other Implementations

Figure 12A:
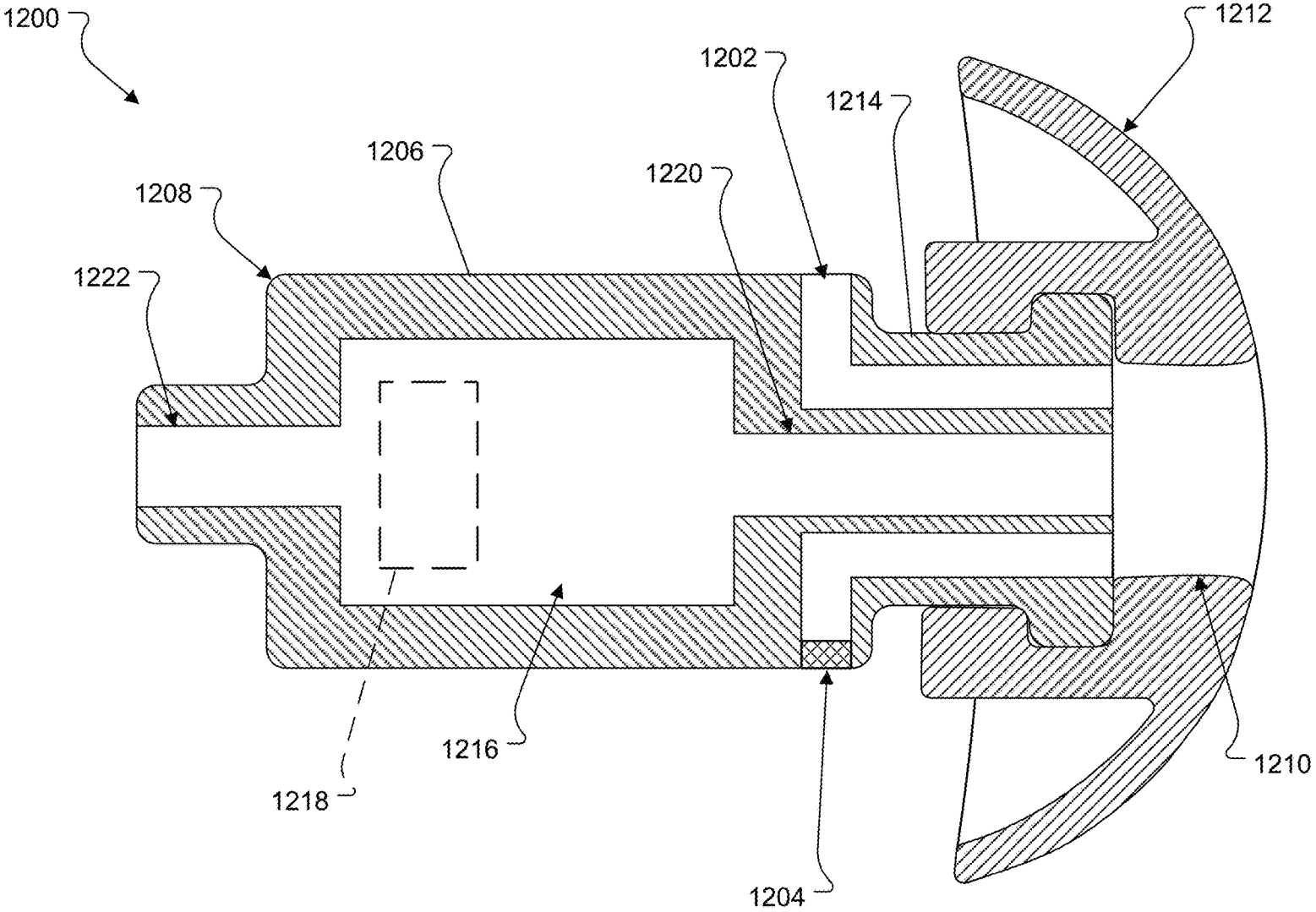
FIG. 12A is a cross-sectional side view of an earpiece with an acoustic mass element and an acoustic resistance element arranged acoustically in parallel in an earbud.

While an implementation has been described in which an acoustically parallel combination of an open hole and a resistive port are provided in a wall of an ear tip, in other implementations one or both of the open hole and the resistive port may be provided in an earbud. For example, FIG. 12A shows an implementation of an earpiece 1200 in which an open hole 1202 (a/k/a "acoustic port") and a resistive port 1204 are arranged, acoustically in parallel, in the housing 1206 of an earbud 1208. First open ends of the open hole 1202 and the resistive port 1204 are acoustically coupled to a hollow passage 1210 in an ear tip 1212 that is coupled to a nozzle 1214 of the earbud 1208, and second open ends of the open hole 1202 and the resistive port 1204 are arranged along an exterior surface of the earbud housing 1206 so as to acoustically couple a user's ear canal to the external environment when the earpiece 1200 is worn. The housing 1206 defines a cavity 1216 within which an electro-acoustic transducer 1218 (a/k/a "speaker," or "receiver," or "driver") may be disposed, e.g., for a RIC style hearing aid. The cavity 1216 is acoustically coupled to an acoustic passage 1220 in the nozzle 1214, e.g., such that the electro-acoustic transducer 1218 can be acoustically coupled to a user's ear when the earpiece is worn. The housing 1206 also defines a receptacle 1222 for receiving wiring for powering the electro-acoustic transducer 1218 or a tube for acoustically coupling the cavity 1216 to an external electro-acoustic transducer, e.g., for a BTE style hearing aid.

While various examples have been discussed above with specific reference to RIC and BTE style hearing aids, one of ordinary skill in the art would appreciate that the principles discussed herein would also be applicable to concha-only earpieces, such as Invisible-In-the-Canal (IIC), Completely-In-Canal (CIC), In-The-Canal (ITC), and In-The-Ear (ITE) styles of hearing aids. For example, FIG. 12B illustrates an implementation of an exemplary concha-only earpiece.

Figure 12B:
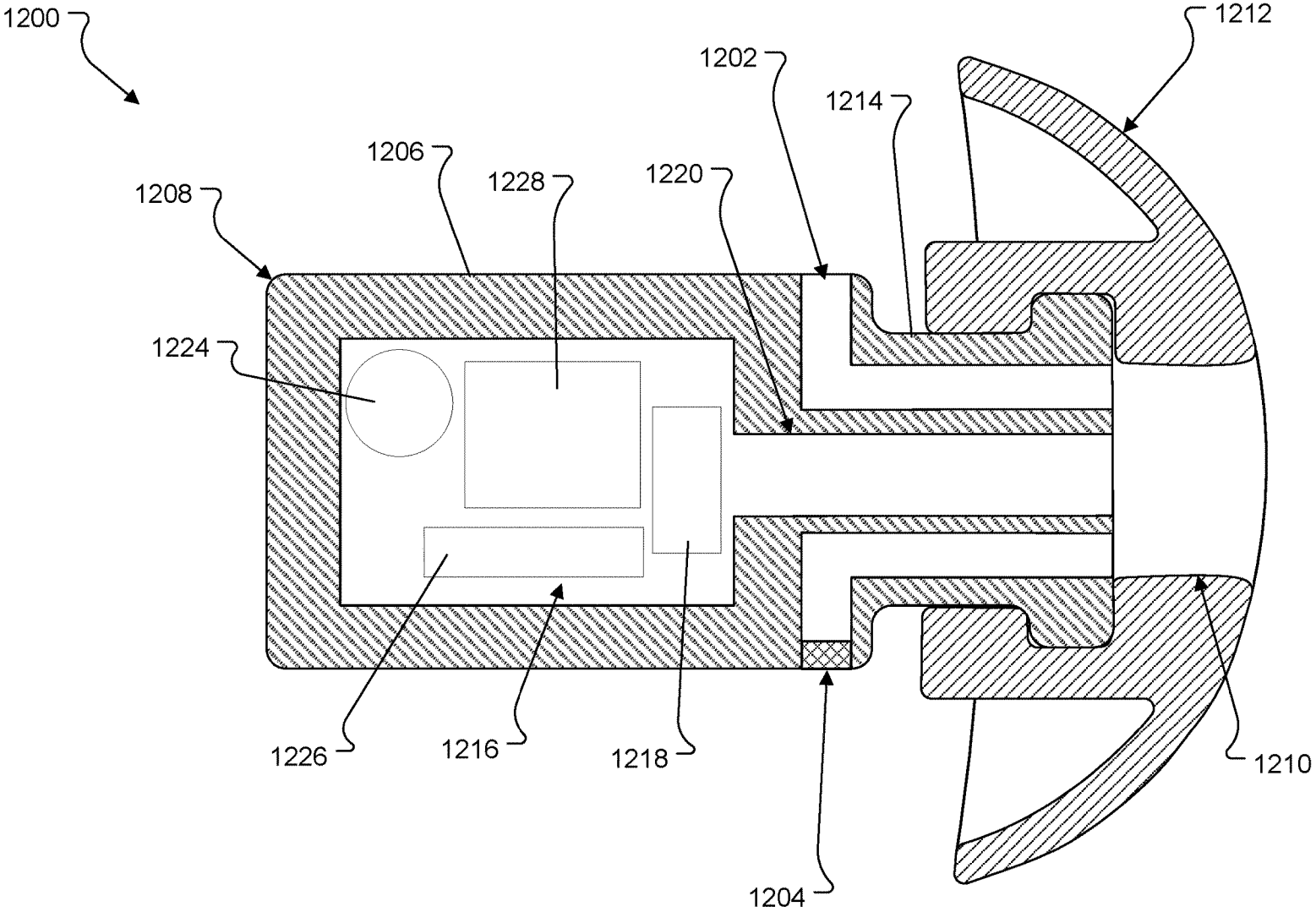
FIG. 12B is a cross-sectional side view of an alternative earpiece for a concha-only style hearing aid with an acoustic mass element and an acoustic resistance element arranged acoustically in parallel in an earbud.

FIG. 12B shows an implementation of an earpiece 1200 in which an open hole 1202 (a/k/a "acoustic port") and a resistive port 1204 are arranged, acoustically in parallel, in the housing 1206 of an earbud 1208. First open ends of the open hole 1202 and the resistive port 1204 are acoustically coupled to a hollow passage 1210 in an ear tip 1212 that is coupled to a nozzle 1214 of the earbud 1208, and second open ends of the open hole 1202 and the resistive port 1204 are arranged along an exterior surface of the earbud housing 1206 so as to acoustically couple a user's ear canal to the external environment when the earpiece 1200 is worn. However, one of ordinary skill in the art would appreciate that one or both of the acoustic mass element and the acoustic resistance element may, in the alternative, be incorporated in the ear tip 1212 as in implementations described above.

In the implementation of FIG. 12B, the housing 1206 defines a cavity 1216 within which an electro-acoustic transducer 1218, a microphone 1224, a battery 1226, and a sound processor 1228. The cavity 1216 is acoustically coupled to an acoustic passage 1220 in the nozzle 1214, e.g., such that the electro-acoustic transducer 1218 can be acoustically coupled to a user's ear when the earpiece is worn.

Figure 13:
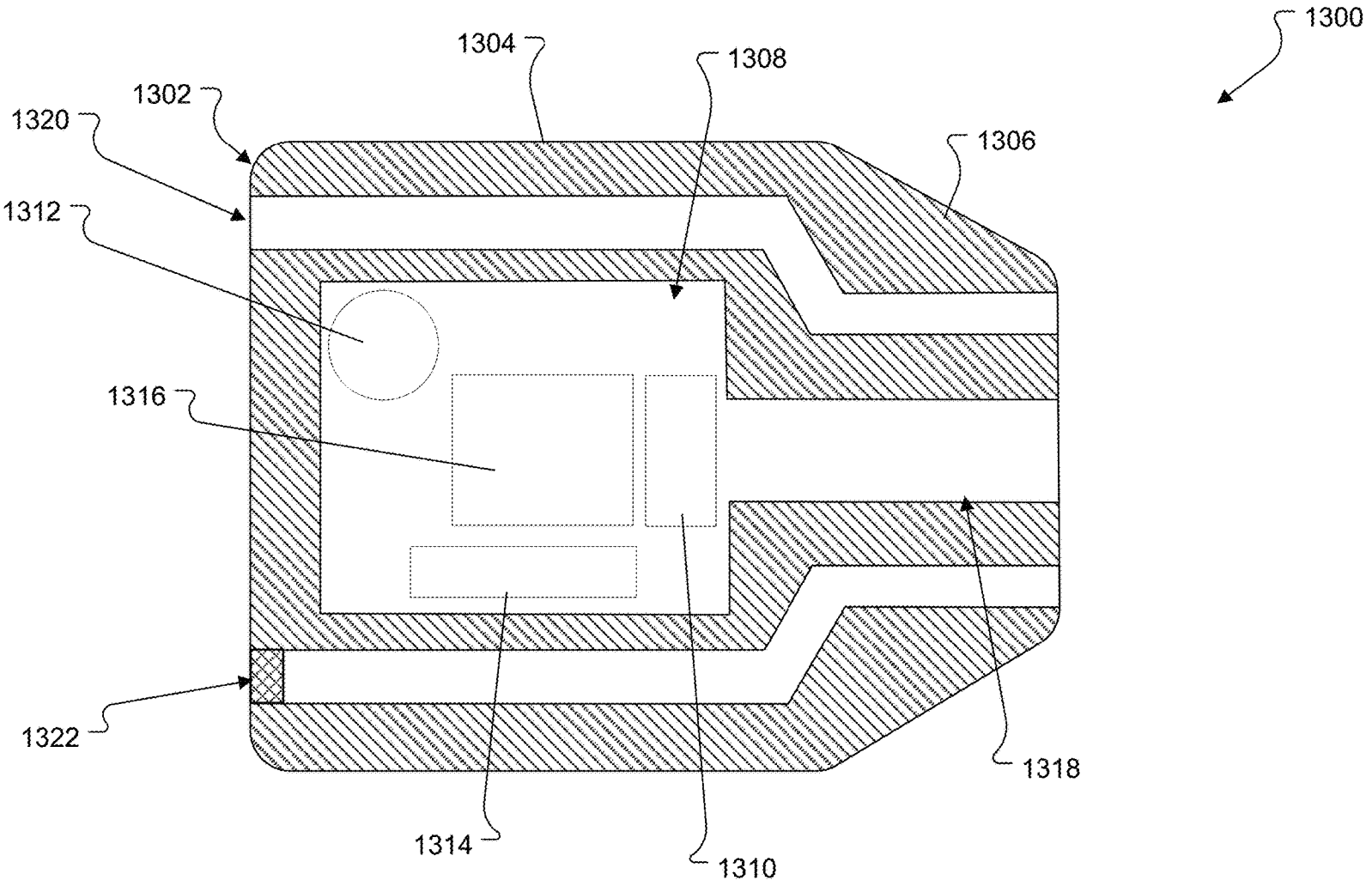
FIG. 13 is a cross-sectional side view of an alternative earpiece with an acoustic mass element and an acoustic resistance element arranged acoustically in parallel in an earbud.

Although implementations have been described in which an earpiece includes an earbud and an ear tip coupled to the earbud, FIG. 13 illustrates another implementation of an earpiece 1300 that includes an earbud 1302 without an ear tip. The earbud 1302 is configured to engage a user's ear canal directly to form an acoustic seal therebetween. The earbud 1302 includes a housing 1304 that defines a nozzle 1306 that is configured to engage a user's ear canal. The housing 1304 may be formed of, e.g., molded form, a hard plastic such as those described above. The housing 1304 defines a cavity 1308 within which an electro-acoustic transducer 1310, a microphone 1312, a battery 1314, and a sound processor 1316. The cavity 1308 is acoustically coupled to an acoustic passage 1318 in the nozzle 1306, e.g., such that the electro-acoustic transducer 1310 can be acoustically coupled to a user's ear when the earpiece is worn.

FIG. 13 illustrates an implementation in which an open hole 1320 and a resistive port 1322 are arranged, acoustically in parallel, in the housing 1304 of the earbud 1302.

First open ends of the open hole 1320 and the resistive port 1322 are arranged to be acoustically coupled to a user's ear canal when worn, and second open ends of the open hole 1320 and the resistive port 1322 are arranged along an exterior surface of the earbud housing 1304 so as to acoustically couple a user's ear canal to the external environment when the earpiece 1300 is worn. While FIG. 13 illustrates an example of a concha-only earpiece, the concepts described with respect to FIG. 13 are equally applicable to earpieces for RIC and BTE style hearing aids.

While acoustic mass elements in the form of open holes or "acoustic ports" have been described, in some cases, other acoustic mass elements may be used. For example, in some implementations a passive radiator may be used as an acoustic mass element.

Furthermore, while an example of a resistive element in the form of a port with a screen has been described, in some implementation the resistive element could take the form of a number of small apertures formed directly in the ear tip or earbud arranged to provide the desired impedance.

Although examples of earpiece have been described which include a single acoustic mass element arranged in parallel with a single acoustic resistance element, other implementations may have additional acoustic mass and/or acoustic resistance elements arranged acoustically in parallel. Additionally, in such implementations, not every mass or resistance element needs to necessarily have the same mass or resistance value. The inclusion of additional mass and/or resistance elements with each potentially having different mass or resistance values can allow for greater flexibility for achieving a more precise shaping of the response.

While various implementations have been described in which an earpiece couples with a casing that houses electronics and is designed to sit behind a user's ear, in other implementations the electronics may be housed in a casing that is designed to wrap around a user's neck, a so-called "nape band," or in a casing that rests behind a user's head.

One of ordinary skill in the art would readily appreciate that many hearing aids have more than one microphone for beamforming, thus, it should be understood that reference to a microphone in the foregoing description is intended to cover configurations with one or more microphones including configurations with microphone arrays.

A number of implementations have been described. Nevertheless, it will be understood that additional modifications may be made without departing from the scope of the inventive concepts described herein, and, accordingly, other implementations are within the scope of the following claims.

What is claimed is:

1. An earpiece comprising:

an eartip comprising:

a dome-shaped outer wall formed from a polymeric material selected from the group consisting of silicone, polyurethane, polynorbornene, thermoplastic elastomer (TPE), and fluoroelastomer;

an acoustic mass element in the form of a first, unobstructed hole that is defined by and extends through the dome-shaped outer wall; and an acoustic resistance element in the form of a second hole with an acoustically resistive material disposed therein, the second hole being defined by and extending through the dome-shaped outer wall and arranged acoustically in parallel with the acoustic mass element, wherein the acoustic mass element and the acoustic resistance element are arranged to couple a user's ear canal to an external environment when worn, and wherein the first hole has a diameter of 1 mm to 3 mm and a length of about 1 mm, and wherein the second hole has a diameter of 1 mm to 3 mm and a length of about 1 mm.

2. The earpiece of claim 1, wherein the acoustic mass element comprises an acoustic port.

3. The earpiece of claim 1, wherein the acoustic resistance element comprises a resistive port.

4. The earpiece of claim 3, wherein the resistive port comprises an acoustic port and an acoustically resistive material arranged to impede movement of acoustic energy through the acoustic port.

5. The earpiece of claim 4, wherein the acoustically resistive material comprises a resistive screen.

6. The earpiece of claim 5, wherein the resistive screen has an acoustic resistance of about 5 Rayl to about 500 Rayl.

7. The earpiece of claim 1, wherein the acoustic resistance element has an acoustic resistance of about 5 Rayl to about 500 Rayl.

8. The earpiece of claim 1, wherein the acoustic resistance element comprises an acoustic damper.

9. The earpiece of claim 8, wherein the acoustic damper comprises a hollow tube and a resistive screen arranged to resist air flow through the hollow tube.

10. The earpiece of claim 1, wherein both the first and second holes extend through the dome-shaped outer wall which has a thickness of about 1 mm in the region of the first and second holes.

11. The earpiece of claim 1, wherein polymeric material provides an acoustic seal with a user's ear canal.

12. A hearing aid comprising:

an earpiece configured to sit at least partially within the user's ear canal when worn, the earpiece comprising:

an eartip comprising:

a dome-shaped outer wall formed from a polymeric material selected from the group consisting of silicone, polyurethane, polynorbornene, thermoplastic elastomer (TPE), and fluoroelastomer;

an acoustic mass element in the form of a first, unobstructed hole that is defined by and extends through the dome-shaped outer wall; and an acoustic resistance element in the form of a second hole with an acoustically resistive material disposed therein, the second hole being defined by an extending through the dome-shaped outer wall and arranged acoustically in parallel with the acoustic mass element, wherein the acoustic mass element and the acoustic resistance element are arranged to couple the user's ear canal to an external environment when worn, and wherein the first hole has a diameter of 1 mm to 3 mm and a length of about 1 mm, and wherein the second hole has a diameter of 1 mm to 3 mm and a length of about 1 mm.

13. The hearing aid of claim 12, further comprising a casing supporting a sound processor and a microphone and configured to sit behind a user's ear when worn, wherein the earpiece is coupled to the casing.

14. The hearing aid of claim 13, further comprising an electro-acoustic transducer disposed within the earpiece, wherein the earpiece is coupled to the casing via wiring for electrically coupling the electro-acoustic transducer to the sound processor.

15. The hearing aid of claim 12, wherein both the first and second holes extend through the dome-shaped outer wall which has a thickness of about 1 mm in the region of the first and second holes.

16. The hearing aid of claim 12, wherein polymeric material provides an acoustic seal with a user's ear canal.

* * * * *